US011450216B2

(12) United States Patent
Maji et al.

(10) Patent No.: US 11,450,216 B2
(45) Date of Patent: Sep. 20, 2022

(54) AIRCRAFT DISPLAY SYSTEMS AND METHODS FOR IDENTIFYING TARGET TRAFFIC

(71) Applicant: HONEYWELL INTERNATIONAL INC., Morris Plains, NJ (US)

(72) Inventors: Sanjib Maji, Bangalore (IN); Mohammed Ibrahim Mohideen, Bangalore (IN); Sindhusree Hasanabada, Bengaluru (IN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 195 days.

(21) Appl. No.: 16/864,356

(22) Filed: May 1, 2020

(65) Prior Publication Data

US 2021/0280075 A1 Sep. 9, 2021

(30) Foreign Application Priority Data

Mar. 9, 2020 (IN) ..... 202011010060

(51) Int. Cl.
*G08G 5/00* (2006.01)

(52) U.S. Cl.
CPC ..... *G08G 5/0078* (2013.01); *G08G 5/0013* (2013.01); *G08G 5/0021* (2013.01)

(58) Field of Classification Search
CPC ... G08G 5/0078; G08G 5/0013; G08G 5/0021
See application file for complete search history.

(56) References Cited

U.S. PATENT DOCUMENTS 7,965,202 B1 * 6/2011 Chiew ..... G01C 23/00 340/974
8,094,188 B1 * 1/2012 Yum ..... G01C 23/005 348/113

(Continued)

FOREIGN PATENT DOCUMENTS

EP 2991057 A2 3/2016
EP 3573038 A1 11/2019

(Continued)

OTHER PUBLICATIONS

US-20210407306-A1, Nielsen, Flight Management System Departure and Arrival Performance Display Based On Weather Data Uplink, Sep. 13, 2021 (Year: 2021).*

(Continued)

*Primary Examiner* — Frederick M Brushaber
*Assistant Examiner* — Elizabeth Yang
(74) *Attorney, Agent, or Firm* — Lorenz & Kopf, LLP

(57) ABSTRACT

Systems and methods are disclosed for identifying traffic to follow, TTF, on a display device. TTF, identification data identifying a vehicle to follow is received. Transmitted data is received from the vehicle to follow. Aircraft attribute data for the vehicle to follow is derived at least from the transmitted data and from target model data from a target model database. The aircraft attribute data includes position, orientation and aircraft dimensions. Enhanced vision system, EVS, imaging data is received from at least one EVS camera. An area of the EVS imaging data to be visually distinguished to highlight the traffic to follow is calculated. The area calculated is based on the aircraft attribute data including position, orientation and aircraft dimensions. Image processing is performed on the area of the EVS imaging data to visually distinguish the area so as to highlight the vehicle to follow, thereby providing highlighted EVS imaging data. A display is generated based on (Continued)

the EVS imaging data and the highlighted EVS imaging data.

20 Claims, 4 Drawing Sheets

(56) References Cited

U.S. PATENT DOCUMENTS

| | | | | |
|---|---|---|---|---|
| 8,099,234 | B1 * | 1/2012 | Frank | G01C 23/005 701/436 |
| 8,736,465 | B2 | 5/2014 | Rutherford et al. | |
| 9,176,324 | B1 * | 11/2015 | Scherer | G08G 5/0021 |
| 10,001,376 | B1 * | 6/2018 | Tiana | G01C 23/005 |
| 10,157,617 | B2 | 12/2018 | Shamasundar | |
| 10,308,371 | B1 | 6/2019 | Tiana et al. | |
| 10,347,138 | B1 | 7/2019 | Manberg et al. | |
| 2017/0103660 | A1 * | 4/2017 | Shafaat | B64D 45/04 |
| 2019/0019422 | A1 | 1/2019 | Khatwa et al. | |
| 2021/0407306 | A1 * | 12/2021 | Nielsen | G08G 5/0091 |

FOREIGN PATENT DOCUMENTS

| | | | |
|---|---|---|---|
| EP | 2239719 | A2 | 10/2020 |
| FR | 3041121 | A1 | 3/2017 |

OTHER PUBLICATIONS

Lawrence J. Prinzel III , Lynda J. Kramer , Kevin J. Shelton , Jarvis J. Arthur , Randall E. Bailey , Robert M. Norman , Kyle L. Ellis & Bryan E. Barmore (2012) Flight Deck Interval Management Delegated Separation Using Equivalent Visual Operations, International Journal of Human-Computer Interaction, 28:2, 119-130, DOI: 10.1080/10447318.2012.634764.

NextGenAir Transportation System, NextGen Avionics Roadmap, Version 2.0, Sep. 20, 2011.

* cited by examiner

AIRCRAFT DISPLAY SYSTEMS AND METHODS FOR IDENTIFYING TARGET TRAFFIC

CROSS REFERENCE TO RELATED APPLICATION

The present application claims benefit of prior filed Indian Provisional Patent Application No. 202011010060, filed Mar. 9, 2020, which is hereby incorporated by reference herein in its entirety.

TECHNICAL FIELD

The present disclosure generally relates to visually identifying traffic to follow or to track such as during cockpit display assisted visual separation procedure and associated systems, methods and software. The present disclosure more particularly relates to methods and systems for highlighting target traffic in cockpit displays.

BACKGROUND

At many busy airports maximum efficiency and minimum delay occur when visual approaches are being conducted by pilots using visual separation from traffic for a portion of the approach. Pilot willingness to accept responsibility for visual separation also affords controllers maximum flexibility in traffic management under conditions of high traffic load. It may be possible to extend that efficiency to lower weather conditions if pilots are able to perform the same separation tasks by reference to a Cockpit Display of Traffic Information (CDTI) in lieu of visual contact out-the-window (OTW). This concept has been developed under the name CDTI Enhanced Flight Rules (CEFR); however, the present disclosure will use the more descriptive and current term of CDTI Assisted Visual Separation (CAVS).

Visual separation can be used to separate two aircraft in terminal areas either by the tower controller, who sees both of the aircraft involved, or by the flight crew who sees the other aircraft involved. When visual separation is to be used, a traffic advisory is issued by ATC to the flight crew. The flight crew then visually searches for the traffic and, when sighted, reports it in sight. The search for aircraft in a dense traffic environment, during reduced visibility, or at night can be challenging. The flight crew may have difficulty visually identifying aircraft and may even identify the wrong aircraft as the traffic of concern. After reporting the aircraft in sight, the flight crew is assigned responsibility for visual separation and a visual approach clearance can be issued. Thereafter, the flight crew is responsible for maintaining visual separation from the Traffic To Follow (TTF) to the runway. While maintaining visual separation, the flight crew must adjust spacing as necessary to maintain a safe arrival interval.

Experience with Traffic alert and Collision Avoidance System (TCAS) has shown that a display with traffic information is an effective enhancement to visual acquisition. The information available on the CDTI may also allow the flight crew to make more accurate spacing judgments and enhance the flight crew's ability to keep the aircraft in sight during less than ideal conditions. If information on a CDTI can be used to perform the visual separation task, visual approaches could continue to be used during conditions under which visual OTW contact cannot be maintained, which would otherwise require visual approaches to be suspended with the subsequent loss of capacity.

The operational concept for CAVS is to use the information available from the CDTI for traffic identification and separation monitoring during single stream arrivals. CAVS makes the transition from pilots using the CDTI to assist with spacing judgments during visual approaches when the aircraft remains continuously in sight OTW to using the CDTI to maintain separation from another aircraft when it has lost sight of the other aircraft OTW. In effect, the operational definition of "visual separation" is expanded to include the use of the CDTI to substitute for OTW visual contact when maintaining pilot determined separation. The source of traffic information is from aircraft equipped with Automatic Dependent Surveillance-Broadcast, ADS-B, data link. ADS-B is a function on an aircraft or surface vehicle that periodically (approximately once or twice a second) broadcasts its three dimensional position and velocity as well as other information.

During CAVS procedures, the flight crew first establishes visual OTW contact with Traffic To Follow (TTF) then correlates that traffic with the corresponding CDTI traffic symbol before using the CDTI to maintain separation. If the visual contact is subsequently lost (for example, as TTF blends with ground lights), the CDTI could then be used to monitor and maintain separation. A later stage of the concept may authorize CDTI based-separation based solely on identification of the displayed target on the CDTI.

It is important the flight crew is able to identify the correct TTF in the CDTI and also to be able to intuitively transition from the real word OTW view of TTF and the CDTI view.

Accordingly, it is desirable to provide methods and systems for identifying TTF during a CAVS procedure that assists flight crew in maintaining identification when transitioning between OTW view and cockpit display view of TTF. In addition, it is desirable to provide such systems and methods in a processing efficient way. Furthermore, other desirable features and characteristics will become apparent from the subsequent detailed description and the appended claims, taken in conjunction with the accompanying drawings and the foregoing technical field and background.

BRIEF SUMMARY

Systems and methods are disclosed for identifying traffic target on a display device. Target traffic identification data is received, which identifies traffic target including an air or ground vehicle. Transmitted data is received from the traffic target. Attribute data for the traffic target is derived at least from the transmitted data. The attribute data includes position, orientation and air or ground vehicle dimensions. Enhanced vision system, EVS, imaging data is received from at least one EVS camera. An area of the EVS imaging data to be visually distinguished to highlight the traffic target is calculated. The area calculated is based on the attribute data including position, orientation and dimensions. Image processing is performed on the area of the EVS imaging data to visually distinguish the area so as to highlight the traffic target, thereby providing highlighted EVS imaging data. A display is generated based on the EVS imaging data and the highlighted EVS imaging data. In embodiments, the target traffic identification data is determined based upon a user selection made on a lateral and/or vertical presentation of neighboring traffic generated by a CDTI computer.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
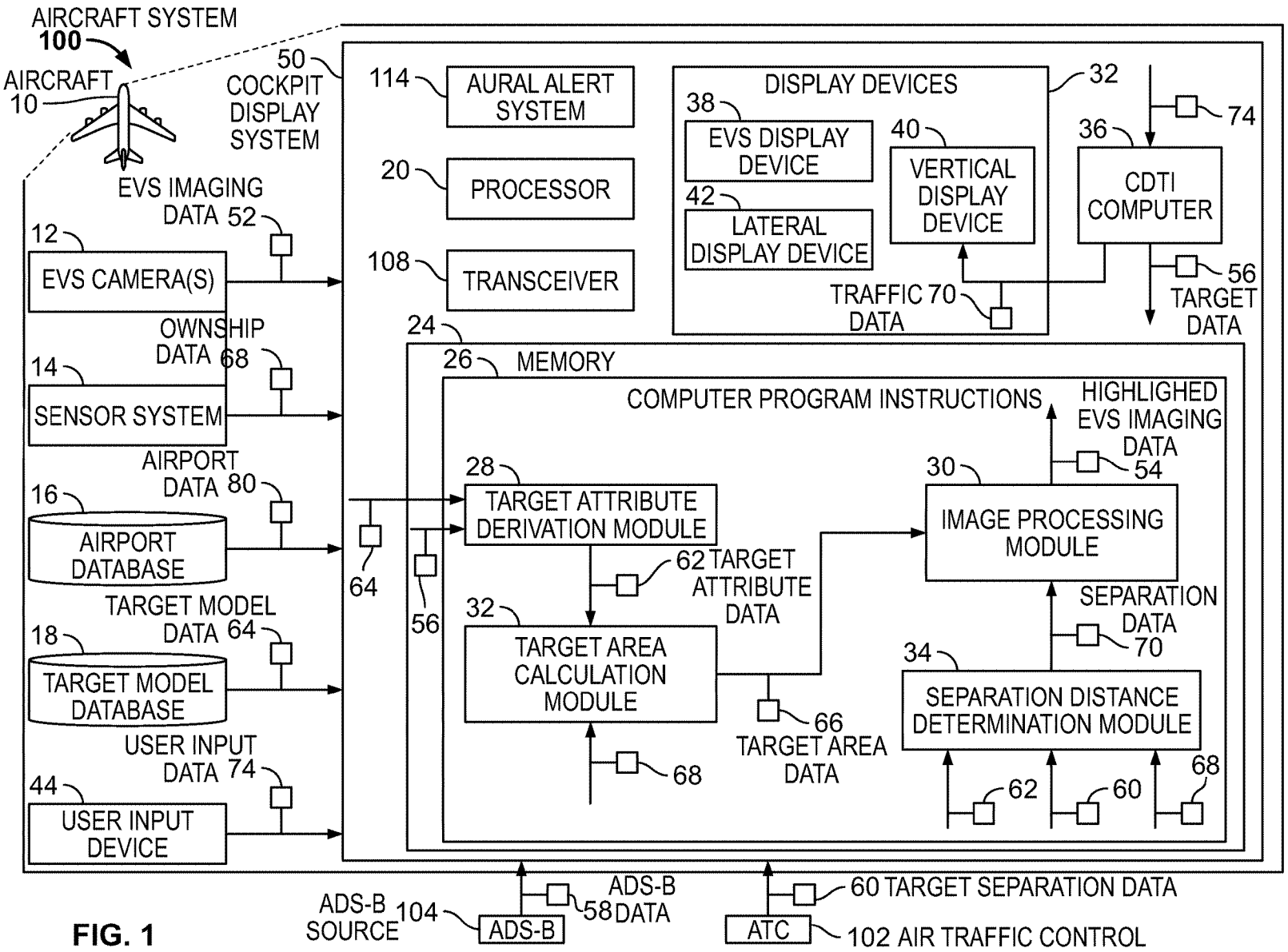
FIG. 1 illustrates a block diagram of an aircraft system including a cockpit display system for highlighting target traffic, in accordance with embodiments of the present disclosure.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

Techniques and technologies may be described herein in terms of functional and/or logical block components and/or modules, and with reference to symbolic representations of operations, processing tasks, and functions that may be performed by various computing components or devices. Such operations, tasks, and functions are sometimes referred to as being computer-executed, computerized, software-implemented, or computer-implemented. It should be appreciated that the various block components and modules shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

When implemented in software or firmware, various elements of the systems described herein are essentially the code segments or instructions that perform the various tasks. In certain embodiments, the program or code segments or programming instructions are stored in a tangible processor-readable medium, which may include any medium that can store or transfer information. Examples of a non-transitory and processor-readable medium include an electronic circuit, a semiconductor memory device, a ROM, a flash memory, an erasable ROM (EROM), a floppy diskette, a CD-ROM, an optical disk, a hard disk, or the like.

As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

According to embodiments of the present disclosure, an Enhanced Vision System (EVS) provides a real time picture in front of an aircraft during a CAVS (CDTI (Cockpit Display of Traffic Information) Assisted Visual Separation) procedure. In embodiments, EVS images are captured through InfraRed (IR) and/or MilliMeter Wave (MMW) camera. An EVS display of traffic to be followed by the aircraft provides a natural and intuitive information to the pilot about the traffic to follow (TTF). The display shows the real image of the TTF on the EVS, thereby facilitating the pilot in synchronizing with the Out The Window (OTW) view.

Embodiments of the present disclosure provide systems and methods that receive input about a selected TTF from a CDTI computer automatically or based on a pilot selection or preference. Further inputs from the CDTI computer include position of the traffic, type of traffic, speed, heading and orientation data. Systems and methods described herein identify and highlight the TTF on the EVS display based on the information received from the CDTI computer. Identifying and highlighting TTF on the EVS allows for a reduced workload for a pilot in maintaining a separation with the TTF. The pilot is provided with a well identified TTF display that is similar to the OTW view. The pilot may not be required to continuously see outside to monitor the TTF because of the enhanced display and identification of the TTF described herein. The described systems and methods provide an additional aid to enhance the crew's visual perception during a CAVS procedure.

The described systems and methods include the processor based step of receiving EVS imaging data from one or more EVS cameras and receiving information about TTF from a CDTI computer. The processor determines an area of the EVS imaging data including the TTF. The processor adds an outline around the TTF in an EVS display to highlight the TTF. Further, the TTF is highlighted by image processing such as brightness or contrast enhancement.

Systems and methods disclosed herein additionally, in some embodiments, receive information of separation distance to be maintained and trigger a warning based on the separation distance by, for example, changing the outline color. The systems and methods depict the separation distance in an intuitive way to blend with the surroundings being displayed on the EVS display. This will help the pilot to correlate the surroundings being viewed OTW and the perception on the EVS display.

The present systems methods can also support paired landing by identifying the traffic landing on a parallel runway simultaneously. This will aid the pilot to maintain separation from the traffic landing simultaneously.

Systems and methods described herein are additionally useful during surface movement to follow an identified traffic ahead or any other follow me vehicle. Thus, TTF includes airborne craft and ground-based vehicles (including aircraft and other airport vehicles). In a ground based system, a pilot provides an input through a CDTI display identifying surface traffic to be followed. The follow me vehicle is identified and highlighted on the EVS display by processing the image received through one or more EVS cameras. In this way, the vehicle to follow is marked on the EVS display to aid the pilot in following the vehicle ahead.

Systems and methods described herein identify TTF through the following steps. The position of traffic target is received from the CDTI computer. Various further parameters are derived concerning the TTF including pitch, roll, heading and trend information and aircraft or vehicle type information. The dimensions of the target TTF is retrieved based on the aircraft/vehicle type from a target model database. An area is calculated based on the dimensions, orientation and position of the target, where the calculated area is a portion of EVS image space that contains the target TTF. This area will be calculated dynamically and will change depending on aircraft/vehicle dimensions, relative distance to the target (which will change the size of the aircraft in EVS image space) and relative orientation of the target (which will also change the size and shape of the target in EVS image space). The target area is subjected to image processing to display the target in a distinguished manner to differentiate it from the remainder of the EVS image.

Having summarized some features of the systems and methods disclosed herein in the foregoing, further details are described in accordance with the exemplary embodiments of FIGS. 1 to 4. Referring to FIG. 1, an aircraft system 100 is shown in block diagram form, in accordance with an exemplary embodiment. Aircraft system 100 includes one or more EVS cameras 12, a sensor system 14, an airport database 16, a target model database 18, a user input device 44 and a cockpit display system 50. Aircraft system 100 is at least partly included within aircraft 10 and is in communication with one or Automatic Dependent Surveillance-Broadcast sources 104 and Air Traffic Control 102. Cockpit display system 50 includes display devices 32 including an EVS display device 38, a lateral display 42 and a vertical display 40. The cockpit display system 50 includes one or more processors 20 executing computer program instructions 26 stored on memory 24. The computer program instructions 26 include target attribute derivation module 28, target area calculation module 32, separation distance determination module 34 and image processing module 30 among other modules (not shown). Further, cockpit display system includes a CDTI computer 36.

In accordance with various embodiments, the cockpit display system 50 operates through processor 20 executing computer program instructions 26. Cockpit display system 50 generates an EVS presentation 400 (see FIG. 4) on the EVS display device 38 based on EVS imaging data 52. The EVS presentation 400 includes a highlighted portion 402 (see FIG. 4) by which a traffic target is distinguished as compared to the surrounding EVS presentation 400. The highlighted portion 402 is based on highlighted EVS imaging data 54 that has been generated by the image processing module 30. That is, the highlighted portion 402 is not wholly synthetic, but is mostly founded on real EVS imaging data 52, albeit image processed for differentiation and enhanced visibility.

The cockpit display system 50 obtains target data 56 for traffic target from the CDTI computer 36. That is, traffic target is identified and selected in one of a variety of ways to be described herein. CDTI computer 36 outputs target data 56 including a variety of parameters concerning the traffic target including an identifier, type, position, trend and orientation information. CDTI computer 36 generates the target data 56 based at least one ADS-B data 58 from the one or more ADS-B sources 104 concerning air and ground traffic. The target attribute derivation module 28 derives target attribute data 62 including target position and orientation information and dimensions of the target ground or air vehicle. In embodiments, the target attribute derivation module 28 retrieves target model data 64 corresponding to the type of traffic target and derives the dimensions of the traffic target therefrom.

The target area calculation module 32 calculates an area of the EVS imaging data 52 to be visually distinguished to highlight the traffic target. The area calculated is based on the target attribute data 62. Target area calculation module 32 scales and rotates the dimensions of the traffic target based on relative position and orientation with respect to ownship, and also takes into account the trend information and known latency in the target data 56 obtained from the CDTI computer 36, to provide a target area in EVS image space that closely conforms to position, shape and size of the traffic target. The target area calculation module 32 thus outputs target area data 66 representing size, shape and position of the target area in EVS image space.

The image processing module 30 performs one or more image processing operations on a localized target area of the EVS imaging data 52 defined by target area data 66, thereby saving on processing resources and allowing the enhancement of the EVS imaging data 52 to be confined to the target area. Image processing includes brightness and/or contrast enhancement such that the target area is still founded on real EVS imaging data 52. Further, a synthetic outline at the edge of the target area may be included by image processing in order to visually specify the target of interest.

The separation distance determination module 34 receives target separation data 60 representing a separation distance to be maintained. The target separation data 60 is obtained from Air Traffic Control (ATC) or some other source (e.g. retrieved from memory 24) and the separation distance determination module 34 determines a difference between ownship position (which is known based on ownship data 68 from sensor system 14) and the traffic target position (which is known from ADS-B data 58 or target data 56) and this is compared with separation distance to be maintained. The separation distance determination module 34 outputs separation data 70 providing a metric representing a difference between the separation to be maintained and the actual separation. When the aircraft gets closer to the traffic target than defined by the separation distance to be maintained, the image processing module 30 either triggers displaying of the outline or changes the color of the outline. Further, different colors for the outline may be used based on how far beyond the separation distance to be maintained the aircraft 10 has travelled.

The one or more EVS cameras 12 generate and supply real time (with some inherent latency (e.g. a maximum latency of 100 ms) including display logic) EVS imaging data 52 to cockpit display system 50. Cockpit display system 50 is configured, in one embodiment, as a CVS (Combined Vision System), which combines EVS imaging data 52 and SVS (Synthetic Vision System) data. In embodiments described herein, aircraft system 100 includes the aircraft model database 18 (e.g. a comprehensive 3D model aircraft database) to enable aircraft or ground vehicle dimensions or even an aircraft or ground vehicle template to be obtained so that a conforming outline of the traffic target can be included as synthetic data in the EVS imaging data 52 when generating a combined vision display. That is, a combined vision display includes at least target vehicle dimensions and possibly also target vehicle shape from target model database 18 (suitably scaled and rotated) located at the position of traffic target in the EVS imaging data 52 to provide a realistic outline of the traffic target. It should be appreciated that whilst the present disclosure is described primarily in terms of aircraft traffic intruders, other traffic (including ground traffic) may be similarly modelled and represented on the EVS display device 38. EVS display device 38 may also be referred to herein as a combined vision display.

In embodiments, one or more EVS cameras 12 is an airborne system that captures a forward-looking scene for display through EVS display device 38 so as to provide a presentation that can be better than unaided human vision in at least some situations. EVS camera 12 includes imaging sensors (one or more) such as a color camera and an infrared camera or radar. EVS camera 12 includes, in embodiments, a millimeter wave radar (MMW) based imaging device, a visible low light television camera, one or more InfraRed (IR) cameras (possibly including more than one infrared camera operating at differing infrared wavelength ranges) and any combination thereof to allow sufficient imaging in poor visibility conditions (e.g. because of night time operation or because of inclement weather). In embodiments, EVS camera 12 is mounted in or near the nose of aircraft of aircraft system 100.

In embodiments, CDTI computer 36 receives and processes information from one or more sources of traffic information in order to generate traffic data 70. Traffic information may be obtained from broadcast mechanisms, such as, traffic information service-broadcast (TIS-B), one or more ADS-B sources 104, and Automatic Dependent Surveillance-Rebroadcast (ADS-R), or via Traffic Alert and Collision Avoidance System (TCAS) or any combination thereof. Information may be broadcast from ATC 102 or other ground station broadcasts, other aircraft and other ground vehicles. In embodiments, CDTI computer 36 is configured to process ADS-B data (among other data inputs) received by an ADS-B receiver (not shown) and output traffic data 70 via one or more communication buses. In embodiments, CDTI computer 36 receives information regarding traffic from other aircraft, ground vehicles, and ground systems to compute traffic states that may include position, velocity, acceleration, time, altitude, heading, aircraft/vehicle size, systems status, phase of operation, vehicle identifier (e.g. tail number), etc. Thus, the CDTI computer 36 receives via transceiver 108, wireless signals comprising traffic information. In various embodiments, the traffic information is provided from the ADS-B source 104.

Figure 3:
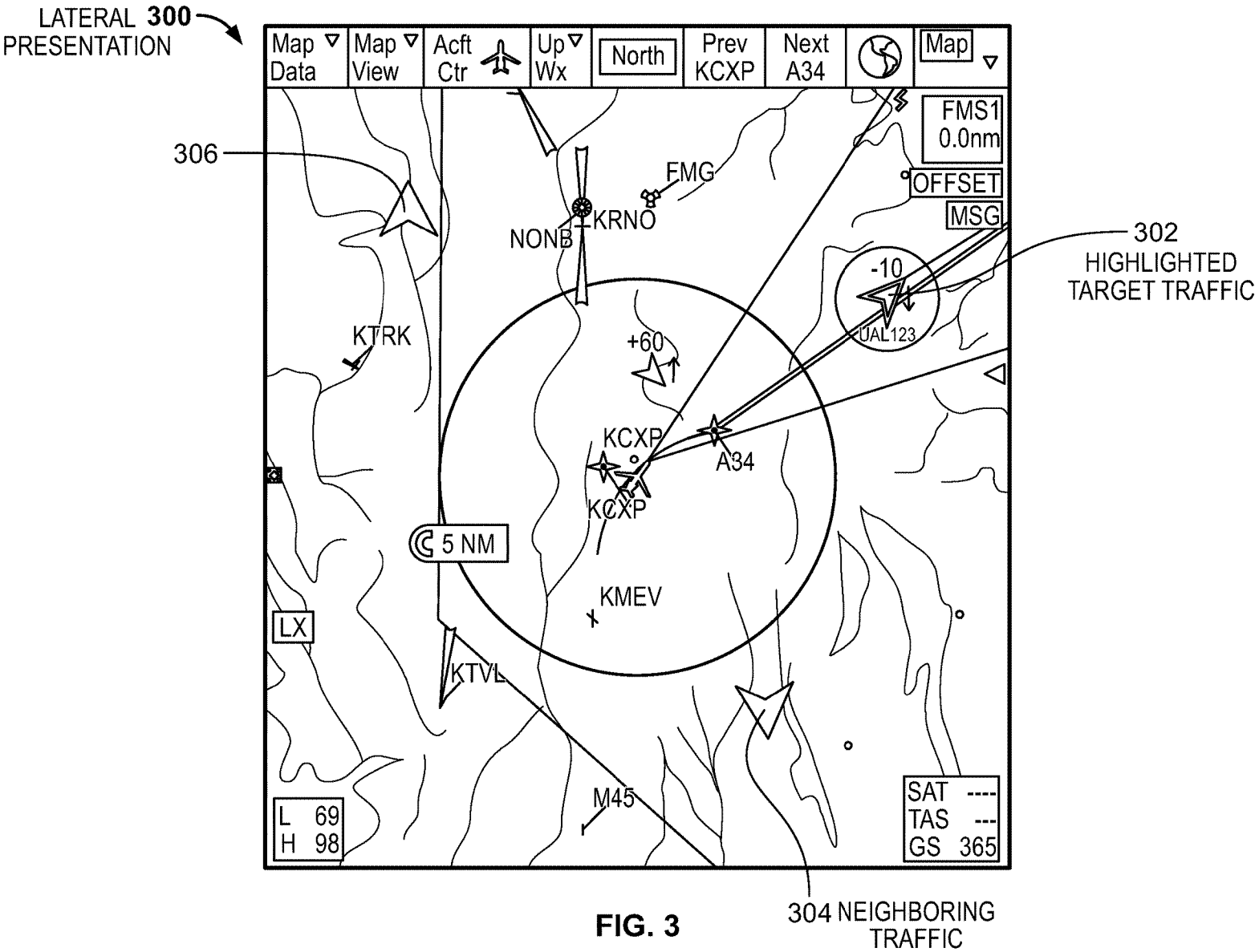
FIG. 3 provides an exemplary lateral display of traffic, in accordance with embodiments of the present disclosure.

In some embodiments, CDTI computer 36 integrates CAVS procedures on the vertical situation display (VSD) device 40 and/or the lateral display device 42 of the cockpit display system 50. In operation, the CDTI computer 36 displays neighbor traffic on both a lateral display presentation 300 (see FIG. 3) and/or a vertical display presentation (not shown) based on the output traffic data 70. In embodiments, the CDTI computer 36 responds to user selections of traffic on either of the lateral and vertical presentations that are made using user input device 44. The lateral and/or vertical presentation 300 may be updated so as to synthetically highlight traffic target that has been selected through the user input device 44. FIG. 3 provides an exemplary lateral presentation 300 including highlighting 302 (in the form of a ring and differentiating coloring in this example) of a user selected target. In other embodiments, the traffic target may not be user selected and the traffic target is derived automatically, e.g. based on information received from ATC 102. Cockpit display system 50 is responsive to the selected traffic target so that the traffic target is additionally highlighted in EVS imaging data 52 and so that the traffic target is distinguishably identified through image processing in the EVS presentation 400 (see FIG. 4) of EVS display device 38.

Neighbor traffic are understood to have appropriate ADS-B out capability, such that the ADS-B source 104 may provide reliable ADS-B data 58 describing traffic. In the depicted embodiment, the CDTI computer 36 processes ADS-B data 58 received from the ADS-B source 104 and identifies neighbor traffic therein. The CDTI computer 36 commands the display devices 32 to render images comprising the neighbor traffic and other features associated with CDTI for a pilot to review.

A transceiver 108 enables the CDTI computer 36 to establish and maintain the communications links to onboard components (not shown), and the ADS-B source 104. The transceiver 108 may include at least one receiver and at least one transmitter that are operatively coupled to the cockpit display system 50. The transceiver 108 can support wired and a variety of types of wireless communication, and can perform signal processing (e.g., digitizing, data encoding, modulation, etc.) as is known in the art. In some embodiments, the transceiver 108 is integrated with the cockpit display system 50.

In various embodiments, the user input device 44 may include any one, or combination, of various known user input device devices including, but not limited to: a touch sensitive screen; a cursor control device (CCD) (not shown), such as a mouse, a trackball, or joystick; a keyboard; one or more buttons, switches, or knobs; a voice input system; and a gesture recognition system. In embodiments described herein, user input device 44 allows user selection of a traffic target in a lateral and/or vertical presentation of traffic made by CDTI computer 36. In response, CDTI computer 36 generates target data 56 including at least an identifier of selected traffic target.

The display devices 32 may be an integration of three components, the lateral display device 42 providing a lateral presentation, the vertical display device 40 providing the vertical situation presentation 300 and the EVS display device 38 providing the EVS presentation 400. The display devices 32 may be implemented using any one of numerous known display devices suitable for rendering textual, graphic, and/or iconic information in a format viewable by a user. The display devices may provide three dimensional or two dimensional presentations and may provide synthetic vision imaging. Non-limiting examples of such display devices include cathode ray tube (CRT) displays, and flat panel displays such as LCD (liquid crystal displays) and TFT (thin film transistor) displays. Accordingly, each display device responds to a communication protocol that is either two-dimensional or three, and may support the overlay of text, alphanumeric information, or visual symbology. The various display device(s) 32 may each, individually, be responsive to user input via user input device(s) 44 and/or be under the control of the cockpit display system 50.

An aural alert system 114 may comprise any combination of speakers, bells, or alarms sufficient to generate sound that the pilot can hear. The aural alert system 114 may receive commands from the CDTI computer 36 and convert the commands into emitted sounds. Accordingly, the aural alert system 114 may comprise a means for converting the commands into emitted sounds.

Sensor system 14 includes a Global Positioning System (GPS) or global navigation satellite system (GNSS) receiver. Sensor system 14 further includes an inertial measurement unit including one or more gyroscopes and accelerometers. Sensor system 14 determines location and orientation of the aircraft 10 based on global position data obtained from satellites, e.g. by trilateration with three or more satellites and based on inertial measurements. In some embodiments, sensor system 18 determines location of aircraft 10 based on Wide Area Augmentation System (WAAS) or other augmented satellite-based global position data. A network of ground-based reference stations provides measurements of small variations in the GPS satellites' signals so that onboard GPS or GNSS receivers use the corrections while computing their positions to improve accuracy of location measurements. Sensor system 14 includes sensors distributed throughout the aircraft 10 to provide various readings concerning the aircraft 10 including speed, acceleration, altitude, orientation, position, etc. Sensor system 14 embodies position and orientation information in the output ownship data 68.

The processor 20 and the computer program instructions 26 on the memory 24 perform the processing activities of cockpit display system 50. The processor 20 may comprise any type of processor or multiple processors, single integrated circuits such as a microprocessor, or any suitable number of integrated circuit devices and/or circuit boards working in cooperation to carry out the described operations, tasks, and functions by manipulating electrical signals representing data bits at memory locations in the system memory, as well as other processing of signals.

A computer readable storage medium, such as a memory 24, may be utilized as both storage and a scratch pad. The memory locations where data bits are maintained are physical locations that have particular electrical, magnetic, optical, or organic properties corresponding to the data bits. The memory 24 can be any type of suitable computer readable storage medium. For example, the memory 24 may include various types of dynamic random access memory (DRAM) such as SDRAM, the various types of static RAM (SRAM), and the various types of non-volatile memory (PROM, EPROM, and flash). In certain examples, the memory 24 is located on and/or co-located on the same computer chip as the processor 20. In the depicted embodiment, the memory 24 stores the above-referenced computer program instructions 26 and modules thereof and any required variables.

The databases 16, 18 are computer readable storage mediums in the form of any suitable type of storage apparatus, including direct access storage devices such as hard disk drives, flash systems, floppy disk drives and optical disk drives.

A bus (not shown) serves to transmit programs, data, status and other information or signals between the various components of the cockpit display system 50. The bus can be any suitable physical or logical means of connecting computer systems and components. This includes, but is not limited to, direct hard-wired connections, fiber optics, infrared and wireless bus technologies.

During operation, the modules 28 to 34, stored in the memory 26, are loaded and executed by the processor 20. During operation, the processor 20 loads and executes one or more programs, algorithms and rules embodied as computer program instructions contained within the memory 24 and, as such, controls the general operation of the cockpit display system 50 including the CDTI computer 36. In executing the processes described herein, such as the method 200 of FIG. 2, the processor 20 loads and specifically executes the computer program instructions 26, to thereby realize an unconventional technological improvement to both the cockpit display system 50 and the analysis/use of ADS-B data 58. Additionally, the processor 20 is configured to process received inputs (any combination of the user input provided via user input device 44, and ADS-B data from one or more of the ADS-B source 104) and command and control the display devices 32 based thereon.

It will be appreciated that cockpit display system 50 may differ from the embodiment depicted in FIG. 1. As a first example, in various embodiments, sources other than the ADS-B source 104 may provide traffic information for processing by the cockpit display system 50. In addition, any combination of the user input device 44, the transceiver 108, and the display devices 32 can be integrated, for example, as part of an existing FMS or cockpit display in an aircraft.

Referring to FIG. 3, lateral presentation 300 includes ADS-B neighboring traffic 302, 304, 306. In addition, or alternatively, vertical presentation may depict ADS-B neighboring traffic. Subsequent to the presentation being updated with neighbor traffic data, a pilot or user may view the presentation and selectively, from either the lateral presentation or the vertical presentation, select neighbor traffic as the traffic target to follow.

Responsive to the user selection, the cockpit display system 50 employs one or more techniques to visually distinguish the user selection from remaining traffic on the vertical presentation and/or the lateral presentation 300. Referring to FIG. 3, responsive to the receiving the user selection, the cockpit display system 50 renders a highlighted traffic target 302 including a shape around it (a ring in this example—however, a variety of shapes may be employed) and additionally or alternatively a distinguishing coloring. Further, and with reference to FIG. 4, an EVS presentation 400 includes a highlighted portion 402 of EVS image that is calculated to conform in size and shape to the traffic target. EVS presentation 400 is also Responsive to the user selection.

Cockpit display system 50 includes target attribute derivation module 28, which receives target data 56 from CDTI computer 36 representing the user or automatically selected traffic target and derives target attribute data 62 describing various parameters of the traffic target including position, orientation (e.g. pitch, roll and yaw), identifier and trend information. Target attribute derivation module 28 uses the identifier to look up dimensions of the traffic target in the target model database 18. The dimensions may be described in a template or model for the of the air or ground vehicle corresponding to the traffic target. The target model database 18 returns at least dimensions in the target model data 64 and optionally also a three-dimensional shape of the traffic target as a model or template of the traffic target.

The target area calculation module 32 receives the target attribute data 64 including at least position, orientation and trend information and receives ownship data 68 including position and orientation information from sensor system 14. The target area calculation module 32 outputs target area data 66 representing the size and optionally also the shape of the target traffic in image space for subsequent image processing. In embodiments, target area calculation module 32 uses position and orientation data from ownship data 68 and position and orientation information from target attribute data to transform target dimensions (which are optionally in the form of a three-dimensional model) from real world space to image space of the EVS imaging data 52. Such transformation processes are known to the skilled person. A size of the target area is adaptable based at least on position such that farther away target traffic air or ground vehicles have a smaller target area defined therearound in imaging space. Further, the size and shape of the target area is adapted based on relative orientation of the aircraft 10 and the target traffic. In embodiments, target area calculation module 32 scales and rotates the dimensions (and optionally the three dimensional model) defined in target model data 64 based on relative orientations (including, for example, heading, bearing and attitude) and positions of ownship aircraft 10 and target traffic ground or air vehicle.

In one embodiment, the target area calculation module 32 performs scaling of the dimensions (or vehicle template/3D model) defined by target model data 64 based on relative position and distance of the target aircraft and ownship as derived from ownship data 68 and target attribute data 62. A target size $W_2$ in EVS image is calculated by equation 1:

$$W_2=(L_2*\mathrm{Cot}(c)/L_1)*W_1 \quad \text{(equation 1)}$$

$L_2$ is target traffic length in real world (obtainable from target model database 18), Angle c is relative bearing angle between target heading and perpendicular line of ownship and $W_1$ is EV system image width which is a constant for a particular system. $L_1$ represents a length of EVS image width in real world which is calculated according to equation 2:

$$L_1=2*(D_1/\mathrm{Cos}(a))*\mathrm{Cot}(b) \quad \text{(equation 2)}$$

D1 is distance from ownship aircraft 10 to target which is calculated based on positions of ownship and target traffic, angle a is bearing of target position to the ownership heading line, and angle b is view angle of EVS image which is a constant for this system. The target dimensions/target model is thus scaled according to equations 1 and 2 based on variables including size dimension(s) of target in real world as derived from target model data 64, relative distance of target and ownship aircraft as derived from target attribute data and ownship data 68, heading of ownship aircraft as derived from ownship data 68 and bearing of target as derived from target attribute data 62.

In embodiments, target area calculation module 32 performs rotation (in three dimensions) of the target dimensions/model based on the target heading as derived from target attribute data 62 and ownship attitude which includes heading, pitch and roll as derived from ownship data 68. That is, a relative orientation and heading of ownship aircraft 10 and target ground or air vehicle, allows an angle of viewing by EVS Camera 12 of target vehicle to be determined and thus a required rotation of aircraft model to be calculated.

Target area calculation module 32 thus scales and rotates the target dimensions/model according to position, heading and orientation data of target vehicle and ownship aircraft 10 as derived from target attribute data 62 and ownship data 68. The above described scaling and rotating algorithms are provided by way of example. Other calculations may be performed for scaling and rotating the target dimensions or model from target model data 64 based on transformations of that data from real world space using known position and orientation of target vehicle from target attribute data 56 and based on understanding of image space based on known parameters of EVS camera 12 and orientation and position of EVS camera 12, which is derivable from ownship data 68.

In accordance with various embodiments, image processing module 30 receives the target area data 66 and the EVS imaging data 52 and produces highlighted EVS imaging data 54. Image processing module 30 performs one or more graphics processing operations on only a portion of the EVS imaging data 52 defined by the target area data 66, to thereby efficiently generate the highlighted portion 402 of the EVS presentation, which is defined in highlighted EVS imaging data 54. The highlighted portion 402 includes at least two dimensions of pixel values, at least some of which have been modified as compared to the corresponding pixel values in the EVS imaging data 52 as a result of graphics processing operations. Nonetheless, highlighted portion is still, in major part, a presentation of the real EVS imaging data rather than being wholly synthetic. In some embodiments, image processing module 30 performs at least one of contrast enhancement and brightness enhancement on the target area of the EVS imaging data 52 to generate the highlighted portion 402. A variety of contrast enhancement methods are available including automatic gain control- (AGC-) and histogram equalization- (HE-) based methods. AGC method removes extreme values (e.g., 2% minimum and maximum of the total pixel number) and linearly maps the middle range of values onto an 8-bit domain for display. Histogram equalization normalizes the intensity distribution by using its cumulative distribution function to make the output image tend to have a uniform distribution of intensity. A useful reference for contrast enhancement methods for infrared images can be found from "ANALYSIS OF CONTRAST ENHANCEMENT METHODS FOR INFRARED IMAGES" by Sprinkle Christian, December 2011. Algorithms for increasing brightness of the target area of the EVS imaging data are known, which may include a scalar multiplication of intensity values of the pixels. In this way, highlighted portion 402 conforms to shape and size of the target vehicle, the EVS imaging data 52 is preserved to ensure accurate reflection of OTW situation and yet the target area is clearly differentiated.

EVS display device 38 can be a head down display (HDD), a head up display (HUD), a wearable HUD, a portable display or any combination thereof. In embodiments, display device 30 is a primary flight display of the cockpit system, providing an out of the window view that is partly synthetic (e.g. with instrument readings based on ownship data 68 and optionally graphical augmentations based on airport data 80) and partly based on EVS imaging data 52. Processor 20 overlays or otherwise combines EVS imaging data 52, synthetic data sources (e.g. ownship data 68 and/or airport data 80) and highlighted EVS imaging data 54 from image processing module 30.

Figure 4:
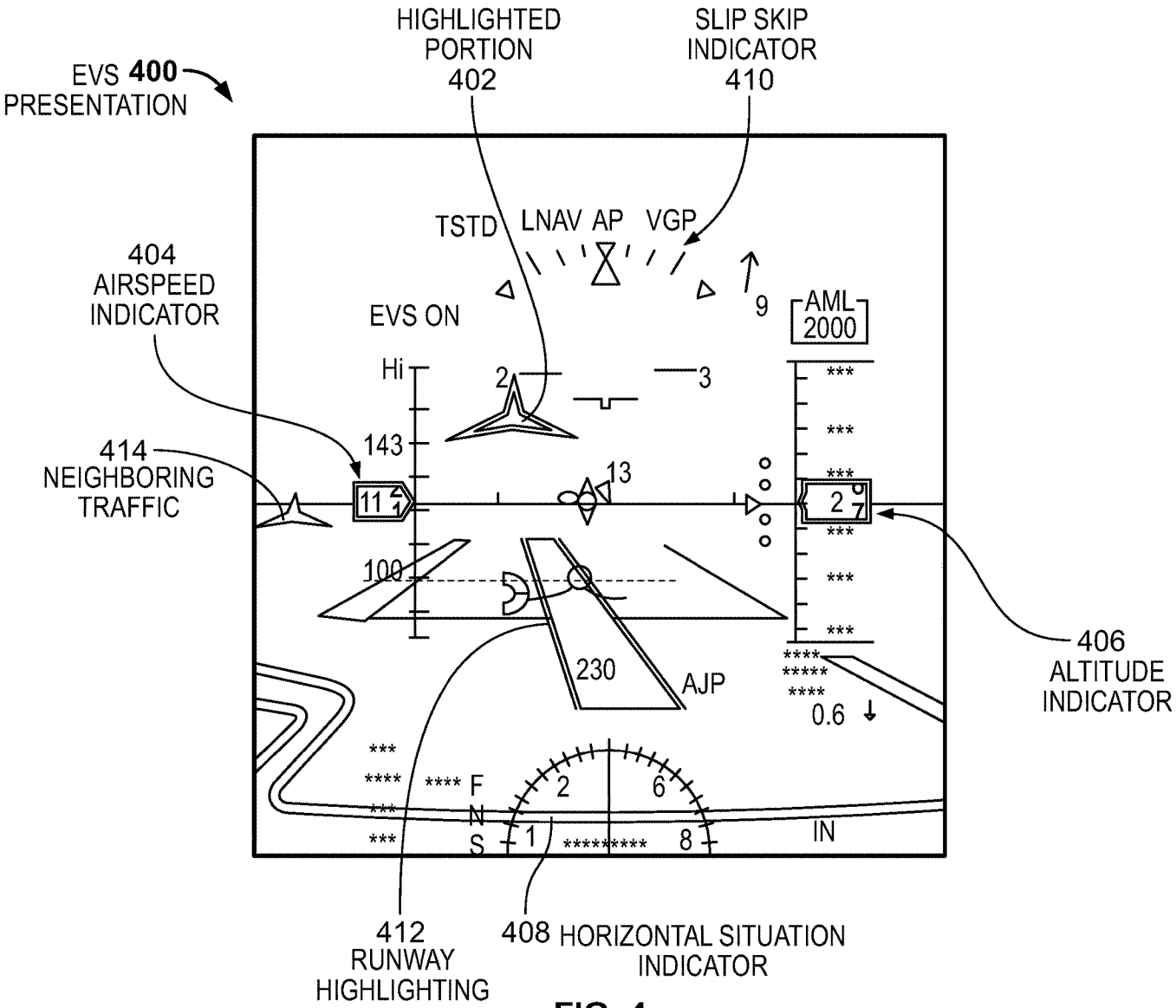
FIG. 4 provides an exemplary presentation of an enhanced vision image with highlighted target traffic.

Referring to FIG. 4 an exemplary EVS presentation 400 by EVS display device 42 is constructed by processor 20 based on highlighted EVS imaging data 54 to provide highlighted portion 402 and based on EVS imaging data 52 surrounding the highlighted portion 402 such that highlighted portion 402 is differentiable to the viewer relative to its surroundings. In some embodiments, the outline of highlighted portion 402 is differentiable solely by differentiating effects produced by contrast and/brightness enhancement performed by image processing module 30. EVS presentation 400 of FIG. 4 illustrates neighboring traffic 414, which has not been highlighted and thus is not as easily viewable in the EVS presentation 400. Synthetic features on EVS presentation 400 includes at least one of the following described synthetic features. EVS presentation 400 includes airport feature highlighting (based on airport data 80 from airport database 16). In the example EVS presentation 400 of FIG. 4, the runway is highlighted on opposed lateral sides by synthetically added lines using positional data for runway obtained from airport data 80. Further, various instrument indicators are included in EVS presentation 400, including at least one of airspeed indicator 404, altitude indicator 406, horizontal situation indicator 408 and slip skip indicator 410.

In other embodiments, a synthetic outline is added (e.g. a graphical line that may be colored different from surroundings) to clearly differentiate the highlighted portion 402. The outline is determined by image processing module 30 based on target area data 66 so as to properly conform to target vehicle. In embodiments, the outline is determined in dependence on a separation distance between the ownship aircraft 10 and the target vehicle based on ownship data 68 and target attribute data 62. Separation distance determination module 34 receives ownship data 68 and target attribute data 62 such that a relative distance (or actual separation) between the ownship aircraft 10 and the target vehicle can be determined based on their respective positions. Further, separation distance determination module 34 receives a separation distance to be maintained (referred to as a separation threshold) from air traffic control 102 or some other source (e.g. from memory 24) in the form of target separation data 60. Separation distance determination module 34 compares the actual separation between the ownship aircraft 10 and the target vehicle and the separation threshold. Separation distance determination module 34 outputs separation data 70, which may be indicative of an alert level or a difference between the actual separation and the threshold separation. Image processing module 30 generates outlining around target area based on the separation data.

When the actual separation is smaller than the separation threshold, a first alert is issued. In some embodiments, there is more than one level of alert corresponding to differing extents of ingress of the separation threshold. For example, when actual separation is less than the threshold separation by an amount of a or less, then a first alert level is issued. When actual separation is less than threshold separation by an amount of greater than a and less than b, then a second alert level is issued. When actual separation is less than threshold separation by an amount of greater than b and less than c, then a third alert level is issued. In this example, a is less than b is less than c. It should be appreciated that more or less alert levels (corresponding to different ranges of overstepping of the separation threshold by the relative distance between the ownship aircraft 10 and the target vehicle) than three can be provided. Each different alert level may be associated with a different color for the outline generated by image processing module 30. For example, for the first alert level (e.g. an advisory alert), a cyan color is used. In some embodiments, no outlining is added when the actual separation is greater than the threshold separation. For example, for the second level alert (e.g. a cautionary alert), a yellow color is used. For example, for the third level alert (e.g. a warning alert), a red color is used. Further, aural alert system 114 may be responsive to separation data 70 to annunciate different alert messages depending on alert level or how far the aircraft 10 (relative to the target vehicle) has gone beyond the threshold separation.

Figure 2:
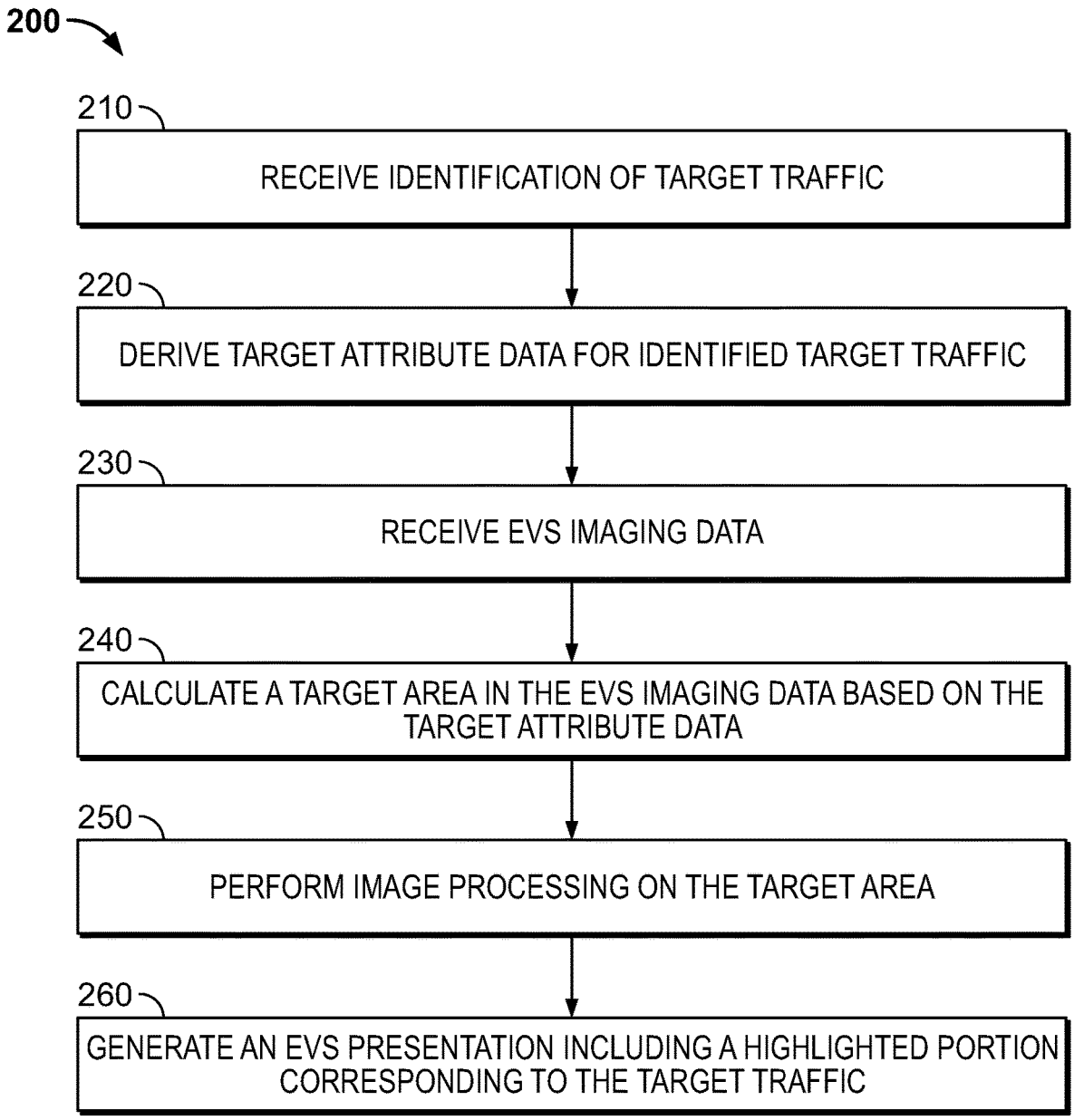
FIG. 2 illustrates a flowchart of a method of highlighting target traffic in an enhanced vision presentation, in accordance with embodiments of the present disclosure.

FIG. 2 illustrates a flowchart of a method 200 of generating a display highlighting a traffic target in the EVS presentation 400, in accordance with various exemplary embodiments. The various tasks performed in connection with method 200 may be performed by software (e.g. program instructions 26 executed by one or more processors 20), hardware, firmware, or any combination thereof. For illustrative purposes, the following description of method 200 may refer to elements mentioned above in connection with FIGS. 1, 3 and 4. It should be appreciated that method 200 may include any number of additional or alternative tasks, the tasks shown in FIG. 2 need not be performed in the illustrated order, and method 200 may be incorporated into a more comprehensive procedure or process having additional functionality not described in detail herein. Moreover, one or more of the tasks shown in FIG. 2 could be omitted from an embodiment of the method 200 as long as the intended overall functionality remains intact.

Method 200 is relevant to CAVS procedures in which TTF is identified and the EVS presentation 400 including the TTF facilitates pilot situation awareness that better maps with the OTW view. It should be appreciated that method 200 is applicable to other procedures such as paired landing and ground following movements.

In embodiments, method 200 for highlight target traffic in EVS imaging data 52 is instigated automatically by CDTI computer 36 when the target traffic is selected through step 210 described below. In another embodiment, a pilot can select an option as to whether to proceed to method 200 using user input device 44. When EVS presentation is very clear and the target traffic can be identified easily by bare eye, the pilot may opt, through user input device 44 (e.g. a setting, preference or in response to a dialogue box) not to have method 200 automatically executed, thus opting not to highlight target traffic.

In step 210, processor 20 receives an identification of target traffic (e.g. TTF). In embodiments, identification of target traffic is provided in the target data 56, which is generated in response to a user input through a vertical and/or lateral display presentation generated by the CDTI computer 36. CDTI computer 36 receives traffic information from at least one source including ADS-B source 104. However, traffic information may be received from at least one further source such as Automatic Dependent Surveillance-Rebroadcast (ADS-R), or via Traffic Alert and Collision Avoidance System (TCAS), or from ATC systems, or any combination thereof. Neighboring traffic is formulated into a lateral and/or vertical presentation. FIG. 3 shows an exemplary lateral presentation 300 showing positions and directions of movement (and possibly other data such as speed and altitude) of neighboring traffic 302, 304, 306. The user (e.g. pilot) is able to select one of the neighboring traffic air or ground vehicles using user input device 44 to thereby identify the target traffic. Although user selection of target traffic is primarily described herein, automated selection of target traffic is envisaged, e.g. based on traffic identified in a communication from ATC 102.

In step 220, target attribute derivation module 28 derives target attribute data 62 for target traffic identified in step 210. In embodiments, various parameters indicating three dimensions of position of traffic target and three dimensions of orientation of target traffic are derived by target attribute derivation module 28 based on target data 56 obtained from CDTI computer 36. For example, longitude, latitude and altitude for position are obtained from target data 56 along with heading, bearing, pitch, roll and yaw for orientation. Yet further, aircraft dimensions are retrieved using an identifier for traffic target (included in target data 56) and by looking up target model database 18. In some embodiments, dimensions and a three-dimensional model of target air or ground vehicle is provided in target model data 64 from target model database 64. The required data items are output from target attribute derivation module 28 as target attribute data 62.

In step 230, EVS imaging data 52 is received by processor 20 from the EVS camera 12. The EVS imaging data 52 is provided as successive frames of EVS imaging data 52 in the form of video. Method 200 is applied for each of the frames.

In step 240, target area calculation module 32 determines a target area in the EVS imaging data 52 that conforms to the traffic target based on the target attribute data 62 and the ownship data 68 including position and orientation. In embodiments, target vehicle dimensions or the target vehicle model is scaled and rotated based on relative position and relative orientation of the aircraft 10 and the target traffic. In this way, a target area is calculated that closely matches the size and shape of the target traffic in the EVS imaging data 52. In some embodiments, target area calculation module 32 further takes into account trend information (included in target attribute data 62) to compensate for any latency in the target data 56 from the CDTI computer 36 (which is based on transmitted ADS-B data 58).

In step 250, the target area portion of the EVS imaging data 52 is subject to image processing by image processing module 30, which includes brightness and/or contrast enhancement or some other image processing operation that preserves realness of the EVS imaging data 52 whilst visually differentiating the target area from the surrounding EVS imaging data 52. Image processing module outputs highlighted EVS imaging data 54 for the target area. In some embodiments, a synthetic, colored, outline is added around a periphery of the target area. The outline may be generated and colored differently depending upon separation data 70 generated by separation distance determination module 34. Separation data 70 is representative of a difference between the threshold separation obtained from ATC 102 and the actual separation between ownship and target traffic. Different alert levels may be defined depending on the distance magnitude between the threshold separation obtained from ATC 102 and the actual separation between ownship and target traffic. These differing alert levels may correspond to different outline colors.

In step 260, an EVS presentation 400 is generated by processor 20 and EVS display device 38, as shown in the example of FIG. 4. The EVS presentation 400 includes the highlighted portion 402 corresponding to the target area and the remainder of the EVS imaging data 52. The highlighted portion includes visually enhanced EVS imaging data and may also include the synthetic outline. The EVS presentation 400 includes further synthetic features including airport features obtained from airport data 80 from airport database 16 and instrument readings obtained from ownship data 68. As such, EVS presentation 400 may be considered to be a combined visual display.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. An aircraft display system of an aircraft, the aircraft display system comprising:

a display device;

a target model database;

at least one processor in operable communication with the display device, the at least one processor configured to execute program instructions, wherein the program instructions are configured to cause the at least one processor to:

receive traffic target identification data identifying a traffic target including a target air or ground vehicle selected by a pilot through a user input device, wherein the target air or ground vehicle is an external vehicle that is to be followed by the aircraft;

receive transmitted data from the traffic target;

derive attribute data for the traffic target at least from the transmitted data and from target model data retrieved from the target model database, the aircraft attribute data including position, orientation and air or ground vehicle dimensions;

receive enhanced vision system, EVS, imaging data from at least one EVS camera;

calculate an area of the EVS imaging data to be visually distinguished to highlight the traffic target, the area calculated based on the attribute data including position, orientation and aircraft dimensions;

perform image processing on the area of the EVS imaging data to visually distinguish the area so as to highlight the traffic target, thereby providing highlighted EVS imaging data; and generate a display to be displayed on the display device based on the EVS imaging data and the highlighted EVS imaging data.

2. The aircraft display system of claim 1, wherein the program instructions are configured to cause the at least one processor to determine a separation distance between ownship aircraft and the traffic target based on the position data and to generate the highlighted EVS imaging data of the traffic to follow to change in dependence on the separation distance.

3. The aircraft display system of claim 2, wherein the program instructions are configured to cause the at least one processor to receive a separation distance to be maintained from Air Traffic Control, ATC, and to generate the highlighted EVS imaging data to change based on a comparison between the separation distance and the separation distance to be maintained.

4. The aircraft display system of claim 1, wherein the highlighted EVS imaging data includes an outline around the traffic target.

5. The aircraft display system of claim 4, wherein the program instructions are configured to cause the at least one processor to determine a separation distance between ownship aircraft and the traffic target based on the position data and to change a color of the outline in dependence on the separation distance, and wherein the program instructions are configured to cause the at least one processor to receive a separation distance to be maintained from Air Traffic Control, ATC, and to change a color of the outline based on a comparison between the separation distance and the separation distance to be maintained.

6. The aircraft display system of claim 1, wherein the program instructions are configured to cause the at least one processor to scale and rotate the air or ground vehicle dimensions based on the location and orientation of the traffic target and to calculate the area based on the scaled and rotated air or ground traffic dimensions.

7. The aircraft display system of claim 1, wherein image processing on the area of the EVS imaging data is performed by a contrast and/or brightness enhancement algorithm.

8. The aircraft display system of claim 1, wherein the attribute data additionally includes trend information for the target, and wherein the program instructions are configured to cause the at least one processor to calculate the area using the trend information to extrapolate the position and orientation to compensate for known latency in the aircraft display system with respect to at least the transmitted data.

9. The aircraft display system of claim 1, wherein the program instructions are configured to cause the at least one processor to generate a display to be displayed on the display device as part of a combined vision system whereby the EVS imaging data, the highlighted EVS imaging data and synthetic features are combined, wherein the synthetic features are based on sensed aircraft parameters including speed, altitude and location and features derived at least from an airport database.

10. The aircraft display system of claim 1, wherein the transmitted data is Automatic Dependent Surveillance-Broadcast ADS-B data.

11. A method for identifying traffic to follow in an aircraft display system of an aircraft, the method comprising:

receiving, via at least one processor, traffic target identification data identifying a traffic target including a target air or ground vehicle selected by a pilot through a user input device, wherein the target air or ground vehicle is an external vehicle that is to be followed by the aircraft;

receiving, via the at least one processor, transmitted data from the traffic target;

deriving, via the at least one processor, attribute data for the traffic target at least from the transmitted data and target model data from a target model database, the attribute data including position, orientation and air or ground vehicle dimensions;

receiving, via the at least one processor, enhanced vision system, EVS, imaging data from at least one EVS camera;

calculating, via the at least one processor, an area of the EVS imaging data to be visually distinguished to highlight the traffic target, the area calculated based on the attribute data including position, orientation and air or ground vehicle dimensions;

performing, via the at least one processor, image processing on the area of the EVS imaging data to visually distinguish the area so as to highlight the traffic target, thereby providing highlighted EVS imaging data; and generating, via the at least one processor, a display to be displayed on the display device based on the EVS imaging data and the highlighted EVS imaging data.

12. The method of claim 11, comprising determining, via the at least one processor, a separation distance between ownship aircraft and the traffic target based on the position data and generating the highlighted EVS imaging data of the traffic target to change in dependence on the separation distance.

13. The method of claim 12, comprising receiving, via the at least one processor, a separation distance to be maintained from Air Traffic Control, ATC, and generating the highlighted EVS imaging data to change based on a comparison between the separation distance and the separation distance to be maintained.

14. The method of claim 11, wherein the highlighted EVS imaging data includes an outline around the traffic target.

15. The method of claim 14, comprising determining a separation distance between ownship aircraft and the traffic target based on the position data and changing a color of the outline in dependence on the separation distance.

16. The method of claim 15, receiving, via the at least one processor, a separation distance to be maintained from Air Traffic Control, ATC, and changing a color of the outline based on a comparison between the separation distance and the separation distance to be maintained.

17. The method of claim 11, wherein image processing on the area of the EVS imaging data is performed by a contrast and/or brightness enhancement algorithm.

18. The method of claim 11, wherein the attribute data additionally includes trend information for the traffic target, and the method comprises calculating, via the at least one processor, the area using the trend information to extrapolate the position and orientation to compensate for known latency in the aircraft display system with respect to at least the transmitted data.

19. The method of claim 11, comprising generating the display to be displayed on the display device as part of a combined vision system, whereby the EVS imaging data, the highlighted EVS imaging data and synthetic features are combined, wherein the synthetic features are based on sensed aircraft parameters including speed, altitude and location and features derived at least from an airport database.

20. The method of claim 11 wherein the transmitted data is Automatic Dependent Surveillance-Broadcast ADS-B data.

* * * * *